US006341914B2

(12) United States Patent
Abe et al.

(10) Patent No.: US 6,341,914 B2
(45) Date of Patent: Jan. 29, 2002

(54) BALLPOINT PEN TIP AND BALLPOINT PEN USING THE SAME

(75) Inventors: Hiroyasu Abe; Masahisa Maki, both of Aichi (JP)

(73) Assignee: The Pilot Ink Co., Ltd., Aichi (JP)

( * ) Notice: Subject to any disclaimer, the term of this patent is extended or adjusted under 35 U.S.C. 154(b) by 0 days.

(21) Appl. No.: 09/842,647

(22) Filed: Apr. 27, 2001

(30) Foreign Application Priority Data

Apr. 28, 2000 (JP) ..... 12-129415

(51) Int. Cl.[7] ..... B43K 7/10
(52) U.S. Cl. ..... 401/216; 401/215; 401/209
(58) Field of Search ..... 401/216, 215, 401/209, 208

(56) References Cited

U.S. PATENT DOCUMENTS

| | | | | |
|---|---|---|---|---|
| 4,457,644 A | | 7/1984 | Yokosuka | 401/216 |
| 4,789,263 A | | 12/1988 | Germann | 401/2.09 |
| 5,520,473 A | * | 5/1996 | Durham | 401/216 |
| 5,899,625 A | | 5/1999 | Ando et al. | 401/216 |
| 5,904,432 A | | 5/1999 | Ando et al. | 401/209 |
| 6,076,987 A | * | 6/2000 | Sekine et al. | 401/216 |

FOREIGN PATENT DOCUMENTS

| | | | |
|---|---|---|---|
| EP | 0 679 535 A2 | 11/1995 | B43K/1/08 |
| JP | 8-11476 | 1/1996 | B43K/1/08 |

OTHER PUBLICATIONS

Abstracts, 8–11476, Jan. 16, 1996.

* cited by examiner

*Primary Examiner*—David J. Walczak
(74) *Attorney, Agent, or Firm*—Sughrue Mion, PLLC

(57) ABSTRACT

A ballpoint pen tip 1 and also a ballpoint pen 7 or 8 using the same. A ballpoint pen tip 1, according to the invention, rotatably holds a ball 5 at its front end portion. The ball 5 is held by a plurality of inwardly projecting portions 3 (as a ball receiving seat) and a front end edge portion 4. The projecting portion 3 are formed by inwardly pressing and deforming a neighborhood of a front end portion of a metallic pipe body 2. The front end edge portion 4 is formed by inwardly pressing and deforming the front end portion of the pipe body 2. In the ballpoint pen tip according to the present invention, a relation of A/T>5.8 is satisfied, where A is an outer diameter of the ball 5 and T is a thickness of the pipe body 2.

20 Claims, 6 Drawing Sheets

BALLPOINT PEN TIP AND BALLPOINT PEN USING THE SAME

BACKGROUND OF THE INVENTION

The present invention relates to a ballpoint pen tip, and also a ball point pen using the same. In detail, the invention relates to a ballpoint pen tip of such a type in which a ball receiving seat is formed by inwardly pressing and deforming a side wall in the vicinity of a front end portion of a metallic pipe body.

In the ballpoint pen tip of this type, conventionally, U.S. Pat. No. 5,899,625 and U.S. Pat. No. 5,904,432 disclosed a ballpoint pen tip in which a ratio (A/T) of an outer diameter A of a ball to a thickness T of a pipe is set to be 5.8 or less, and furthermore, a ratio (D/T) of a depth D of a concave portion to the thickness T of the pipe is set to be 2.0 or less in order to enhance a strength of a ball receiving seat, for example.

Although the conventional ballpoint pen tip having a comparatively small size (for example, 0.3 mm, 0.4 mm or 0.5 mm) is effective in enhancing the strength of the ball receiving seat, the ballpoint pen tip having a large size (for example, 1.0 mm or more) is not preferable in respect of manufacture because the quantity of projection (that is, the quantity of inward pressing and deformation) of an inwardly projecting portion for forming the ball receiving seat is more increased when the outer diameter of the ball is made greater so that a pressing force might be increased during the pressing and deformation and a front end portion of a tool such as a punch for the pressing and deformation might be damaged. On the other hand, even if the thickness of the pipe is simply set to be small in order to easily carry out the pressing and deformation, the thickness of the ball receiving seat itself is reduced so that the strength of the ball receiving seat is lowered.

In the ballpoint pen tip of this type (that is, a ballpoint pen tip of such a type as to form the ball receiving seat through the pressing and deformation), moreover, as the outer diameter of the ball is increased, the size of an ink flowing gap in a central portion of the ball receiving seat tends to be enlarged. Consequently, the capillary force of the ink flowing gap in the central portion is remarkably reduced as compared with that in the ink flowing gap between adjacent inwardly projecting portions. Therefore, it is impossible to rapidly supply ink to the whole ball having a large size so that a blur in handwriting or a break in handwriting might be caused.

In the conventional ballpoint pen tip, furthermore, a spew is easily generated on the outer peripheral edge of a rear end thereof. When the rear end of the ballpoint pen tip is to be pressed and fastened into a fitting hole formed in the front end portion of the penholder or the connecting member, consequently, the outer peripheral edge of the rear end of the ballpoint pen tip (a portion in which the spew is generated easily) bites at the inner face of the fitting hole so that the ballpoint pen tip might be hindered from being pressed and fitted smoothly or pressing and fitting failures might be caused, for example, the inner face of the fitting hole might be damaged. In particular, in the case of the ballpoint pen tip including a ball having a large size, it is necessary to apply a great pressing force depending on a large outer diameter of the pipe. In addition, when the biting at the outer peripheral edge of the rear end is caused, a much greater pressing force is required and the pressing and fitting operations are hard to carry out. Thus, there is a high possibility that the pressing and fitting failures might be caused.

SUMMARY OF THE INVENTION

In order to solve the conventional problems, it is an object of the invention to provide a ballpoint pen tip capable of obtaining a ball receiving seat having easiness of pressing and deformation, a sufficient ink fluidity, a smooth rotation of a ball and a sufficient strength and capable of being smoothly pressed and fitted in a fitting hole even if the ball having a large size is employed.

A ballpoint pen tip, according to the invention, rotatably holds a ball at its front end portion. The ball is held by a plurality of inwardly projecting portions for a ball receiving seat which is formed by inwardly pressing and deforming a neighborhood of a front end portion of a metallic pipe body 2 and a front end edge portion which is formed by inwardly pressing and deforming the front end portion of the pipe body. In the ballpoint pen tip according to the present invention, a relation of A/T>5.8 is satisfied, where A is an outer diameter of the ball and T is a thickness of the pipe body.

The value of the ratio (A/T) of the outer diameter A of the ball to the thickness T of the pipe body 2 is greater than 5.8 (that is, "A/T>5.8"). Therefore, even if the ball 5 having a large size is employed, pressing and deformation for forming the ball receiving seat can be carried out easily. The reason is as follows. Supposing that the value of A/T is equal to or smaller than 5.8 (that is, "A/T≦5.8"), the thickness T of the pipe body 2 is comparatively increased and a great pressing force is required for forming the ball receiving seat even if a strength of the ball receiving seat can be enhanced. Consequently, there is a possibility that the front end portion of a tool (for example, a punch) for pressing and deformation might be damaged and it is hard to carry out manufacture through the pressing and deformation.

Furthermore, it is preferable that the value of A/T according to the present invention is made smaller than 10.0 (that is, "A/T<10.0"). Consequently, it is possible to obtain a ball receiving seat having a sufficient strength. The reason is as follows. If the value of A/T is equal to or greater than 10.0 (that is, "A/T≧10.0"), the thickness T of the pipe body 2 to the outer diameter A of the ball is reduced too much so that the strength of the ball receiving seat is reduced remarkably. Consequently, there is a possibility that a smooth and stable rotation of the ball 5 cannot be obtained for a long period of time.

Accordingly, the ballpoint pen tip 1 according to the invention satisfies a relation of "5.8<A/T<10.0". Consequently, even if the ball 5 having a large size is employed, it is possible to easily carry out the pressing and deformation for forming the ball receiving seat. In addition, it is possible to set such a proper thickness T that the strength of the ball receiving seat is not reduced.

In the ballpoint pen tip 1 according to the present invention, moreover, it is advantageous that a relation of "D/T>2.0" should be satisfied, where D is a depth of a concave portion 32 which is formed at an outside of the inwardly projecting portions 3.

The value of the ratio (D/T) of the depth D of the concave portion 32 to the thickness T of the pipe body 2 is greater than 2.0 (that is, "D/T>2.0"). Therefore, even if the ball 5 having a large size is employed, a sufficient ink fluidity can be obtained without causing a blur in handwriting or a break in handwriting. In addition, the ball 5 can be stabilized and supported sufficiently so that a smooth rotation of the ball 5 can be obtained.

The reason is as follows. If the value of D/T is equal to or smaller than 2.0 (that is, "D/T≦2.0"), the depth D of the concave portion 32 to the thickness T of the pipe body 2 is reduced too much (that is, the quantity of projection of the inwardly projecting portion 3 is reduced too much). In particular, if the ball 5 has a large size, the capillary force of an ink discharging gap 31 in the central portion of the ball receiving seat becomes remarkably smaller than the capillary force of the ink discharging gap 31 (a radial groove) between the adjacent inwardly projecting portions 3. Consequently, the quantity of an ink to be supplied to the ball 5 is lacked so that a blur in handwriting or a break in handwriting is caused. Moreover, if "$D/T \leqq 2.0$" is obtained, the size of the ball receiving seat itself is reduced so that the ball 5 cannot be supported stably. Thus, there is a possibility that the smooth rotation of the ball 5 might not be obtained.

Furthermore, it is advantageous that the value of D/T according to the present invention should be set to be smaller than 4.0 (that is, "$D/T<4.0$". Consequently, it is possible to easily carry out pressing and deformation, and furthermore, it is possible to obtain a ball receiving seat having a sufficient strength. The reason is as follows. If the value of D/T is equal to or greater than 4.0 (that is, "$D/T \geqq 4.0$"), the depth D of the concave portion 32 to the thickness T of the pipe body 2 (that is, the quantity of projection of the inwardly projecting portion 3) is increased too much so that the pressing force is increased during the formation of the concave portion 32. Therefore, there is a possibility that a front end portion of a tool such as a punch might be damaged. In this case, moreover, the thickness of the inwardly projecting portion 3 becomes remarkably smaller, through pressing and plastic deformation, than the thickness T of a portion of the pipe body 2 which is subjected to neither the pressing nor the plastic deformation. Therefore, there is a possibility that the strength of the ball receiving seat might be lacked.

Accordingly, the ballpoint pen tip 1 according to the invention satisfies a relation of "$2.0<D/T<4.0$". Consequently, the thickness T of the pipe body 2 can be set more properly. Even if the ball 5 having a large size is employed, it is possible to avoid a blur in handwriting or a break in handwriting. In addition, it is possible to form a ball receiving seat through easy pressing and deformation without reducing the strength of the ball receiving seat.

The ballpoint pen tip 1 according to the invention mentioned above is more effective in the case in which a ball having a large size is employed. More specifically, it is preferable that the outer diameter A of the ball 5 should be set in the range of 0.7 mm to 1.6 mm . In particular, when the outer diameter A of the ball is set in the range of 0.7 mm to 1.6 mm (more preferably, in the range of 1.0 mm to 1.6 mm), functions and effects according to the invention mentioned above can be produced effectively. Consequently, it is possible to obtain a ball receiving seat having easiness of pressing and deformation, a sufficient ink fluidity, a smooth rotation of the ball and a sufficient strength.

In the ballpoint pen tip 1 according to the present invention, the inwardly projecting portions 3 may be provided in three places, preferably, four places or more.

When the inwardly projecting portions 3 are provided in four places or more, the ball receiving seat can be supported more stably than the case in which the inwardly projecting portion 3 is provided in three portions. Furthermore, in the case in which the number of ink discharging gaps 31 to be provided between the inwardly projecting portions 3 is not three but four or more, an ink can be caused to spread more rapidly over the whole surface of the ball 5 having a large surface area and a large size. Thus, it is possible to obtain a sufficient ink fluidity without causing a blur in handwriting or a break in handwriting. In particular, it is preferable that the number of inwardly projecting portions 3 should be four in that a sufficient ink fluidity can be satisfied and manufacture can be carried out easily.

In the ballpoint pen tip 1 according to the present invention, it is preferable that a curved surface portion 6 should be provided on an outer peripheral edge of a rear end of the pipe body 2.

Consequently, when the ballpoint pen tip 1 is to be pressed into a penholder and a fitting hole of a connecting member, the curved surface portion 6 and the inner face of the fitting hole slide smoothly and there is no possibility that the outer peripheral edge of the rear end of the pipe body 2 might bite at the inner face of the fitting hole to inhibit smooth pressing and fitting in the fitting hole or to generate pressing and fitting failures, for example, to damage the inner face of the fitting hole differently from the conventional art.

Examples of the shape of the pipe body 2 according to the invention include a right cylinder, a taper cylinder and a stepped cylinder having a small diameter portion and a large diameter portion.

The thickness T of the pipe body 2 according to the invention represents a thickness of a front end portion of the pipe body 2 in a part to which the pressing and deformation is not applied (that is, a thickness in the vicinity of the inwardly projecting portion 3) and does not represent thicknesses of the inwardly projecting portion 3 and the front end edge portion 4 which are reduced through the pressing and deformation. Moreover, the thickness T of the pipe body 2 can represent a mean thickness of the front end portion of the pipe body 2 in which the inwardly projecting portion 3 has not been formed.

The depth D of the concave portion 32 according to the invention represents a distance in a radial direction from an outer peripheral surface of the pipe body 2 of the concave portion 32 which has not been formed to the bottom most part of the concave portion 32 which has been formed (that is, the quantity of pressing and deformation in a radial direction of a side wall of the pipe body 2). Moreover, the concave portion 32 is provided in a plurality of places on the outer peripheral surface of the pipe body 2, and the depth D of the concave portion 32 is set to be equal. Furthermore, while the shape of the concave portion 32 may be any of a conical surface, a spherical surface and a prism, the shape of the conical surface is preferable in that the thickness can be changed uniformly and manufacture can be carried out easily.

DETAILED DESCRIPTION OF THE PREFERRED EMBODIMENTS

An embodiment of the invention will be described with reference to the drawings.

Figure 1:
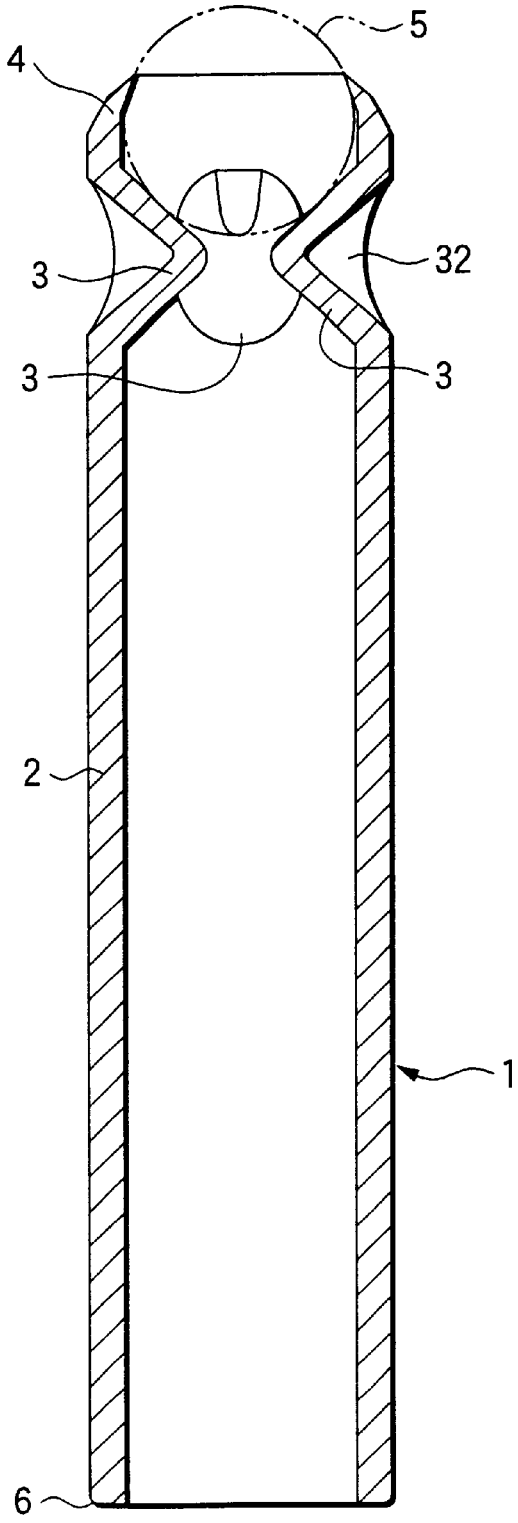
FIG. 1 is a longitudinal sectional view showing an embodiment of the invention.
Figure 2:
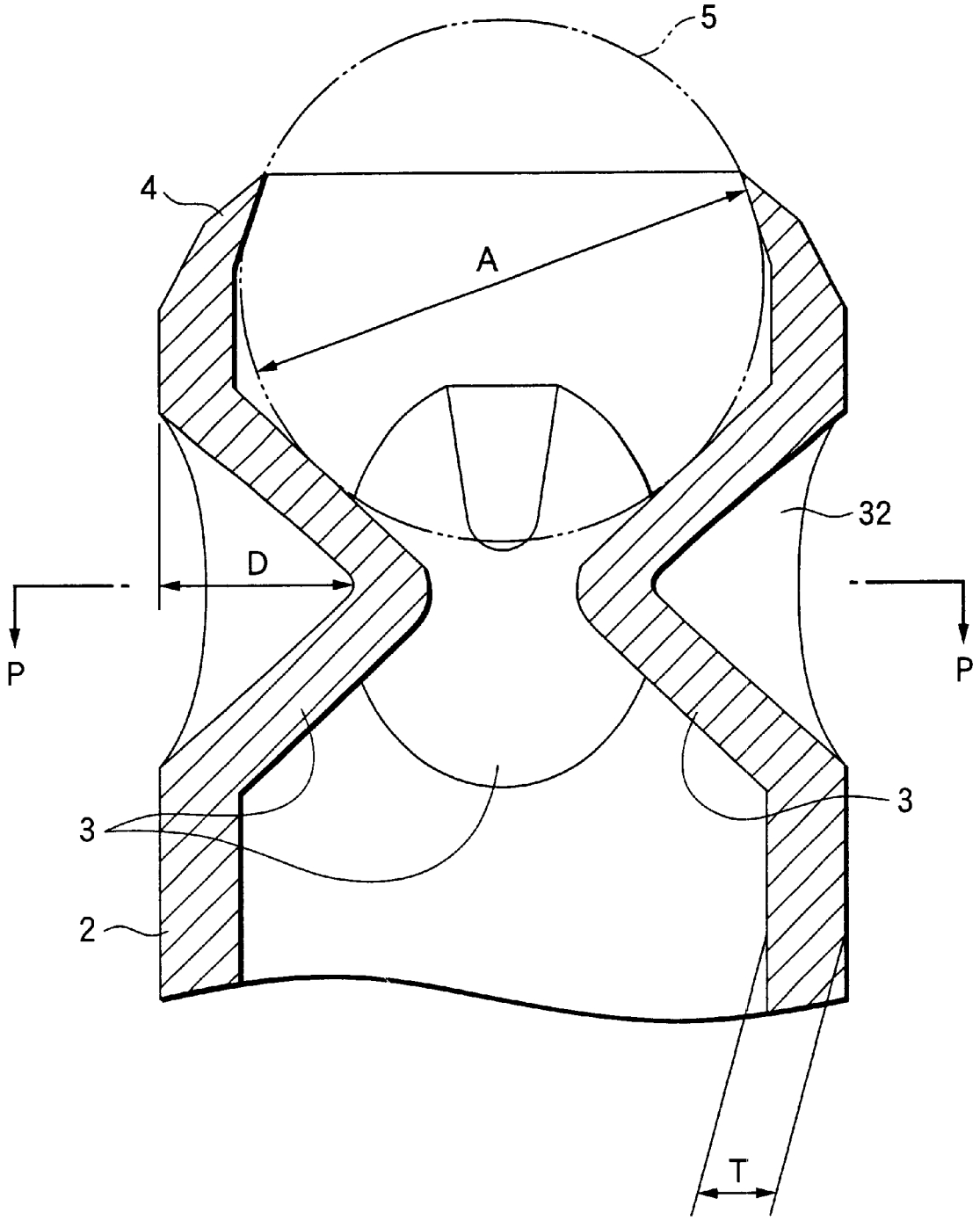
FIG. 2 is an enlarged sectional view showing a main part of FIG. 1.
Figure 3:
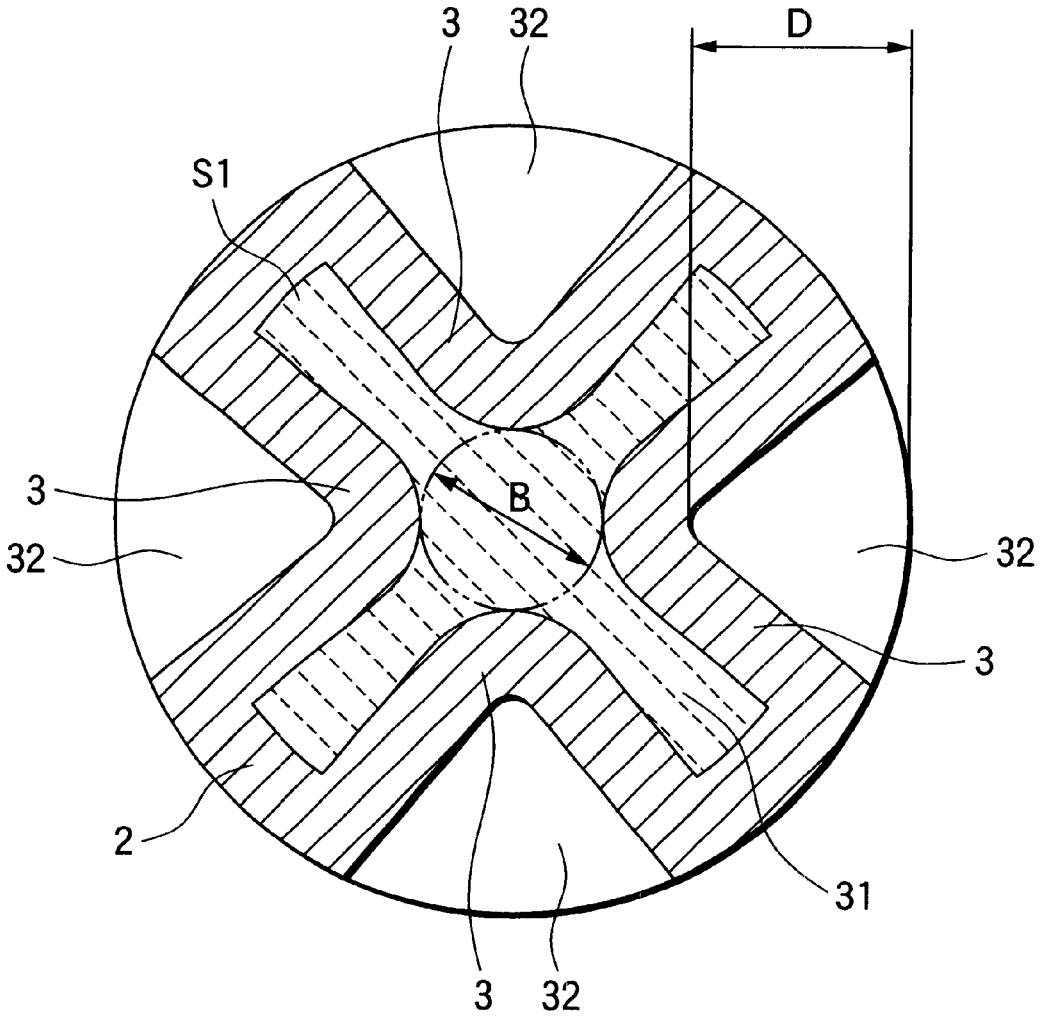
FIG. 3 is an enlarged sectional view taken along the line P—P in FIG. 2.

FIGS. 1 to 3 show the embodiment of the invention.

In a ballpoint pen tip 1 according to the embodiment, a side wall in the vicinity of the front end portion of a right cylindrical pipe body 2 formed of a metal (for example, austenite based stainless steel such as SUS304, SUS305 or SUS321) is pressed and deformed to provide four inwardly projecting portions 3 at regular intervals in a circumferential direction, thereby forming a ball receiving seat. Furthermore, the front end portion of the pipe body 2 is provided with a tapered front end edge portion 4 which is inwardly deformed, and a ball 5 is rotatably held by the inwardly projecting portion 3 (ball receiving seat) and the front end edge portion 4.

Figure 4:
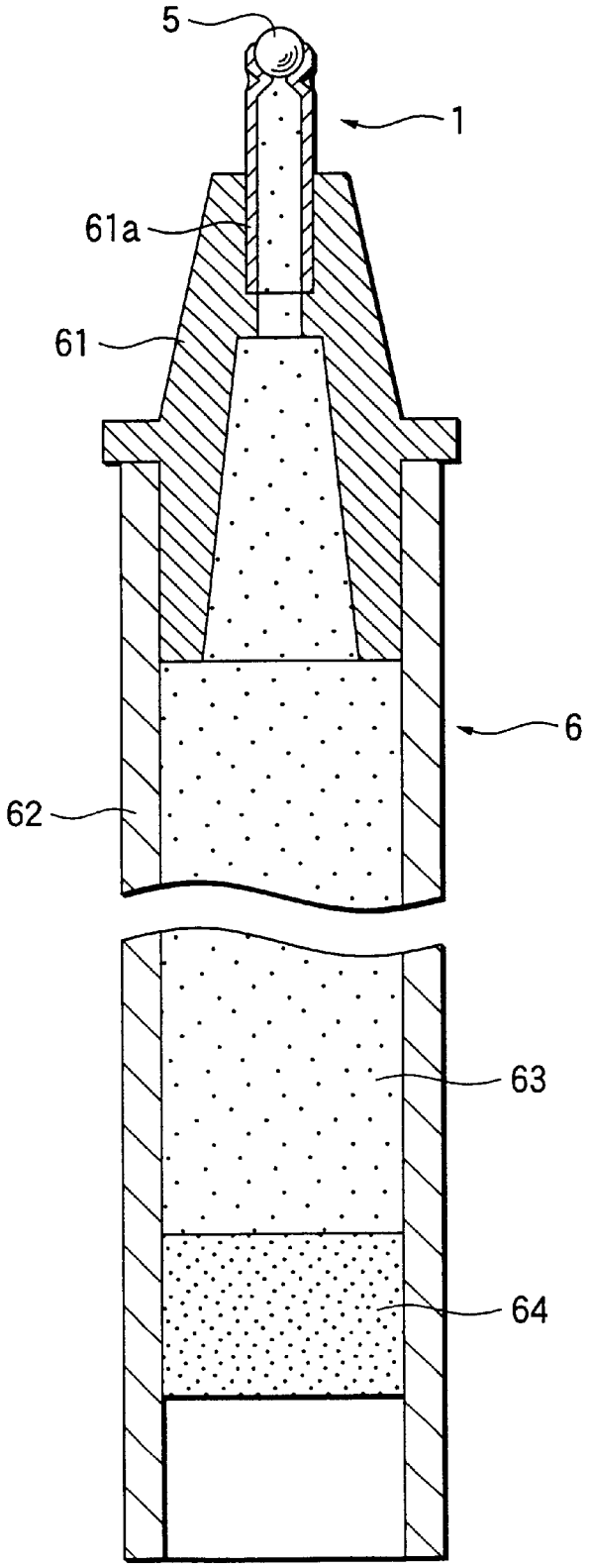
FIG. 4 is a longitudinal sectional view showing a first application example according to the invention.
Figure 5:
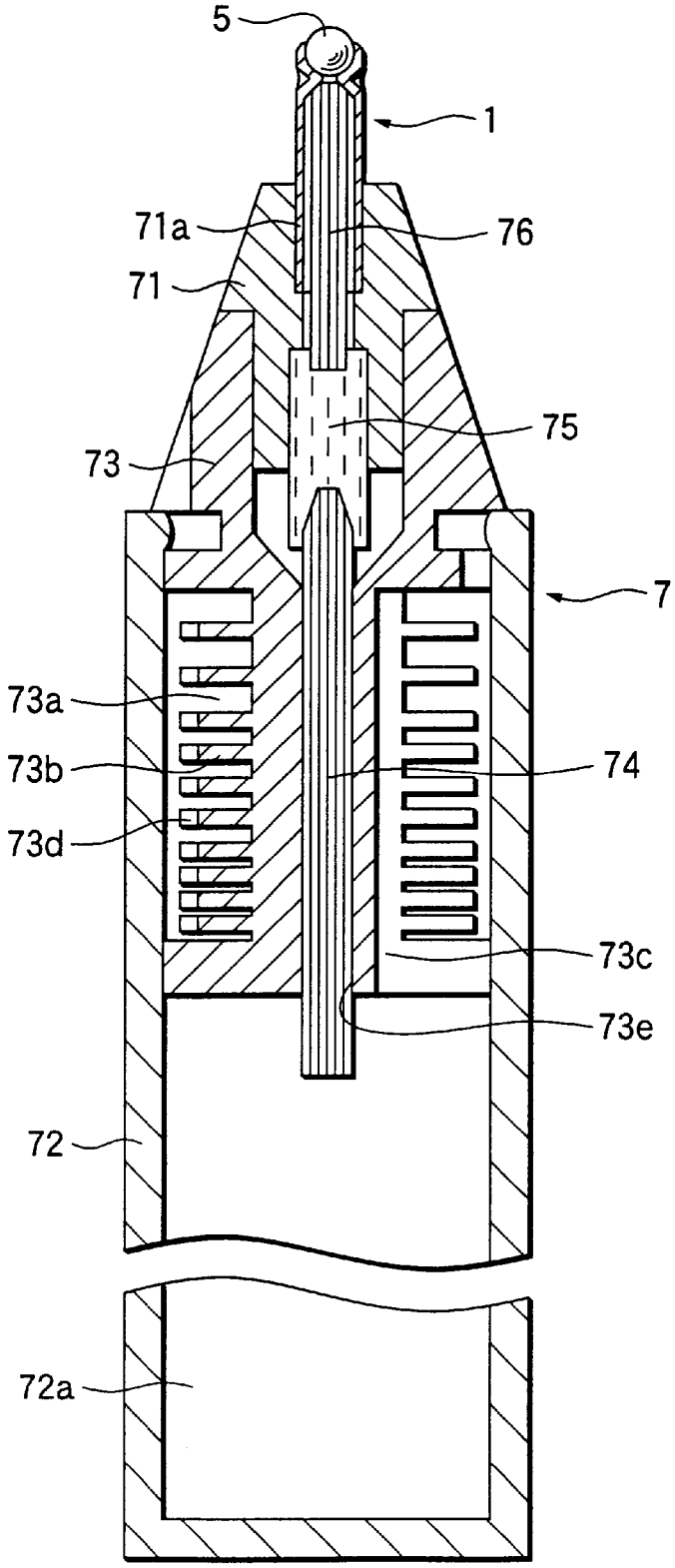
FIG. 5 is a longitudinal sectional view showing a second application example according to the invention.
Figure 6:
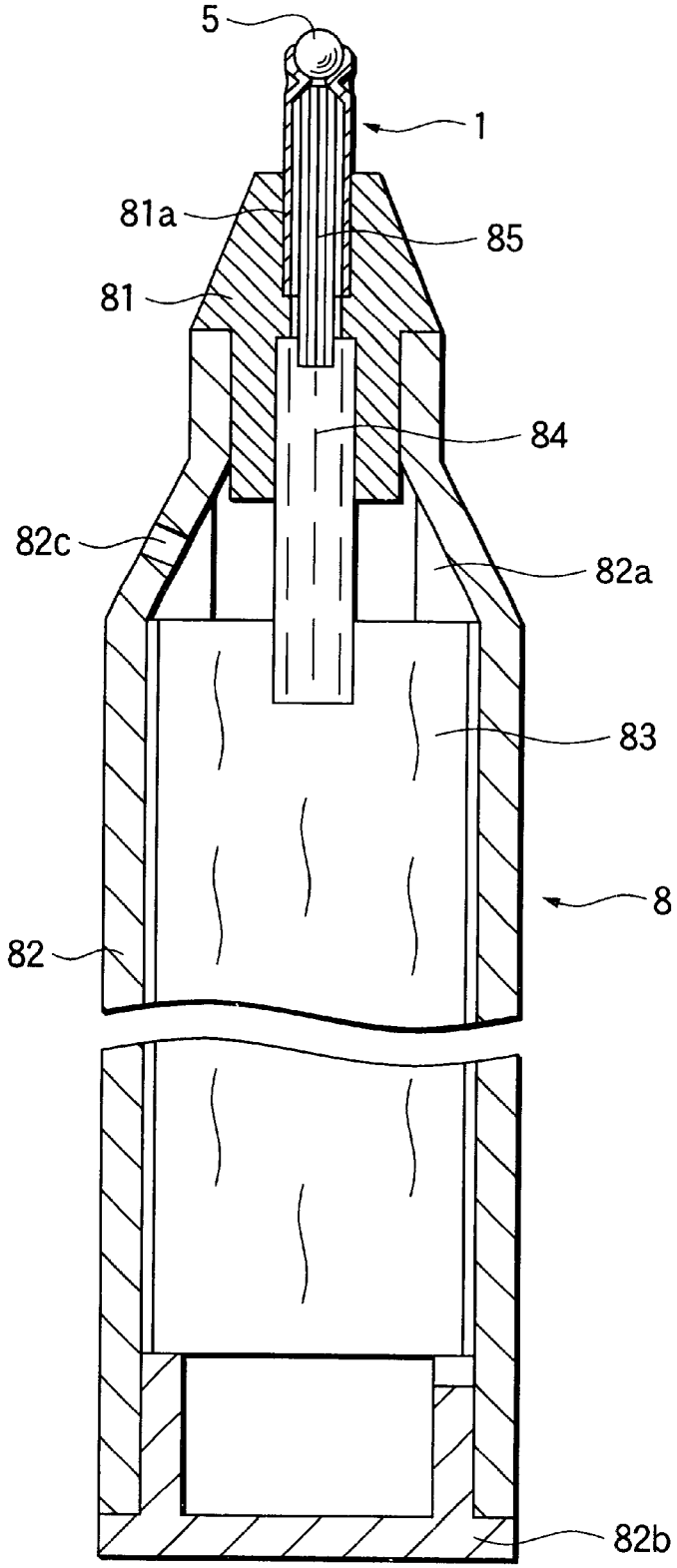
FIG. 6 is a longitudinal sectional view showing a third application example according to the invention.

The metallic pipe body 2 is a straight cylinder and has a longitudinal dimension of 6.2 mm and an inner diameter set to be larger, by approximately 0.03 mm to 0.05 mm, than an outer diameter A of the ball 5 to be employed. Moreover, a convex curved surface portion 6 which is rounded through barrel polishing is formed on the outer peripheral edge of the rear end of the pipe body 2. Consequently, a spew is not generated on the outer peripheral edge of the rear end of the pipe body 2 and the biting of the outer peripheral edge of the rear end of the pipe body 2 and the inner faces of fitting holes 61*a*, 71*a* and 81*a* is avoided when the rear portion of the pipe body 2 is pressed into the fitting holes 61*a*, 71*a* and 81*a* as shown in FIGS. 4 to 6. Thus, pressing and fitting can be carried out smoothly. Moreover, it is preferable that the curved surface portion 6 should have a radius of curvature of approximately 0.03 mm to 0.10 mm because the biting at the inner faces of the fitting holes 61*a*, 71*a* and 81*a* can be prevented sufficiently and manufacture can easily be carried out.

Moreover, it is preferable that the outer diameter of the rear end of the metallic pipe body 2 should be greater than 1.0 mm. If the outer diameter of the rear end of the pipe body 2 to be pressed into the fitting holes 61*a*, 71*a* and 81*a* is greater than 1.0 mm, a great pressing force is required. Therefore, if the outer peripheral edge of the rear end of the pipe body 2 bites at the inner faces of the fitting holes 61*a*, 71*a* and 81*a*, there is a high possibility that the inner faces of the fitting holes 61*a*, 71*a* and 81*a* might be damaged considerably and pressing failures might be caused. However, since the curved surface portion 6 is provided on the outer peripheral edge of the rear end of the pipe body 2, it is possible to obtain a ballpoint pen tip comprising a ball having a large diameter which suppresses the pressing failures.

Moreover, it is preferable that the apexes of the inwardly projecting portions 3 in the four places should not come in contact with each other and a ratio (B/T) of a diameter B of a virtual inscribing circle contacting the apexes to a thickness T of the pipe body 2 should be set in the range of 1.8 to 3.0. Consequently, it is possible to obtain a ball receiving seat having easiness of pressing and deformation and a sufficient strength.

Furthermore, a cross-shaped ink discharging gap 31 is formed between the inwardly projecting portions 3 in the four places. When a sectional area in a radial direction of the ink discharging gap 31 (that is, a cross-shaped groove) is represented by S1 (a slant-line portion shown in a dotted line of FIG. 3) and a sectional area in a radial direction of an inner hole portion of a ball holding portion of the pipe body 2 which has an inner diameter slightly greater than the outer diameter A of the ball is represented by S2, it is preferable that a ratio (S1/S2) of the Si to the S2 should be set in the range of 0.10 to 0.39. If the S1/S2 satisfies the range, the pressing and deformation can easily be carried out and a sufficient ink fluidity can be obtained.

Table 1 shows a value of A/T and a value of D/T which are obtained by a calculation based on a thickness T of the pipe body 2, a depth D of a concave portion 32 and the values of A, D and T in the case in which five kinds of balls 5 (more specifically, 0.7 mm, 1.0 mm, 1.2 mm, 1.4 mm and 1.6 mm) are applied to the ballpoint pen tip 1 shown in FIGS. 1 to 3.

TABLE 1

| A [mm] | D [mm] | T [mm] | A/T | D/T |
|---|---|---|---|---|
| 0.7 | 0.240 | 0.115 | 6.09 | 2.09 |
| 1.0 | 0.370 | 0.135 | 7.41 | 2.74 |
| 1.2 | 0.420 | 0.195 | 6.15 | 2.15 |
| 1.4 | 0.500 | 0.195 | 7.18 | 2.56 |
| 1.6 | 0.550 | 0.195 | 8.21 | 2.82 |

FIG. 4 shows a first application example of the ballpoint pen tip 1 according to the invention. A ballpoint pen 6 (a so-called aqueous gel ink ballpoint pen or an oil ballpoint pen) is obtained by pressing and fastening the ballpoint pen tip 1 according to the invention shown in FIGS. 1 to 3 into the fitting hole 61*a* of the front end portion of a cylindrical connecting member 61 formed of synthetic resin (for example, polyacetal, polypropylene or polyethylene) and by pressing and fastening the connecting member 61 into an opening on the front end portion of an ink reservoir 62 formed of an extrusion molded body made of synthetic resin (for example, polypropylene or polyethylene).

An ink 63 (an aqueous ink having a shear thinning viscosity or an oil ink having a viscosity of 1000 mPa·s to 1000 mPa·s at 20° C.) is accommodated in the ink reservoir 62 and a follower 64 (for example, a greasy substance) which moves forward with the consumption of the ink 63 is accommodated in the rear end of the ink 63.

Second Application Example

FIG. 5 shows a second application example of the ballpoint pen tip 1 according to the invention.

A ballpoint pen 7 (a so-called direct liquid type ballpoint pen), according to one example of the present invention, comprises a connecting member 71 made of synthetic resin (for example, polyacetal, polypropylene or polyethylene) which is formed by pressing and fastening the ballpoint pen tip 1 according to the invention shown in FIGS. 1 to 3 into the fitting hole 71*a* on the front end portion, an ink holding member 73 having the connecting member 71 fastened to a front end portion, and a penholder 72 attaching the ink holding member 73 to a front end portion and having an ink tank 72*a* for accommodating an ink which is formed in a rear portion.

The ink holding member 73 serves to temporarily hold an excess ink depending on a change in an internal pressure of the ink tank 72*a* and is provided with a plurality of comb teeth 73*b* forming a large number of ink holding grooves 73*a* on a peripheral surface, a slit-shaped ink groove 73*c* penetrating through the comb teeth 73*b* in an axial direction and communicating with the ink holding grooves 73*a*, an air exchange concave groove 73*d* provided on the comb teeth 73*b* in an opposite position to the slit-shaped ink groove 73*c*, and a center hole 73*e* penetrating through an axial core which are formed integrally of synthetic resin (for example, ABS resin).

An ink guiding member 74 formed of an extrusion molded body made of synthetic resin is inserted and fixed into the center hole 73*e*. An outer or inner peripheral surface of the ink guiding member 74 is provided with an ink introducing path having a capillary force which is extended in an axial direction. Moreover, an ink relaying member 75 formed of a porous material body or a fiber worked body to which the front end portion of the ink guiding member 74 is connected to be stick-shaped is accommodated in the rear portion of the connecting member 71. Furthermore, the inside of a pipe body 2 of the ballpoint pen tip 1 is provided with a bar-shaped body 76 made of synthetic resin which has a rear end connected to the front end portion of the ink relaying member 75 and a front end portion connected to an ink discharging gap 31 of a ball receiving seat. A clearance having a capillary force is formed between the bar-shaped body 76 and the inner peripheral surface of the pipe body 2 so that the ink is smoothly guided to the back of a ball 5. Moreover, it is also effective that a slit having a capillary force for introducing the ink is provided on the outer peripheral surface of the bar-shaped body 76.

Third Application Example

FIG. 6 shows a third application example of the ballpoint pen tip 1 according to the invention.

A ballpoint pen 8 (so-called inner cotton type ballpoint pen), according to other example of the present invention, comprises a connecting member 81 made of synthetic resin (for example, polyacetal, polypropylene or polyethylene) having a fitting hole 81*a* on a front end portion into which the ballpoint pen tip 1 according to the invention shown in FIGS. 1 to 3 is pressed and fixed, and a penholder 82 provided with a front end opening to which the connecting member 81 is fastened and accommodating an ink impregnation body 83 formed of a porous material body or a fiber worked body therein. The ink impregnation body 83 is impregnated with the ink and is held and fixed by an attaching rib 82*a* provided on an inner wall of the penholder 82 and a tail plug 82*b* fitted in an opening formed on the rear end of the penholder 82.

Moreover, an ink relaying member 84 formed of a porous material body or a fiber worked body which is connected to the ink impregnation body 83 is attached to the rear portion of the connecting member 81. Furthermore, the inside of the pipe body 2 of the ballpoint pen tip 1 is provided with a bar-shaped member 85 (for example, an extrusion molded body made of synthetic resin or a fiber collected worked body) having a rear end connected to the front end portion of the ink relaying member 84 and a front end portion connected to an ink discharging gap 31 of a ball receiving seat. Moreover, an air hole 82*c* for communicating the inside of the penholder 82 with the outside is provided in the front of the penholder 82.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

According to the first aspect of the invention, even if a ball having a large size is employed, the pressing and deformation for forming the ball receiving seat can easily be carried out.

According to the second aspect of the invention, even if a ball having a large size is employed, a sufficient ink fluidity can be obtained without causing a blur in handwriting or a break in handwriting, and the ball can be sufficiently stabilized and supported to obtain a smooth rotation thereof.

According to the third aspect of the invention, it is possible to obtain a ballpoint pen tip including a ball having a specifically large size which comprises a ball receiving seat capable of obtaining easiness of pressing and deformation, a sufficient ink fluidity and a smooth rotation of the ball.

According to the fourth aspect of the invention, the ink can be caused to rapidly spread over the whole surface of the ball having a large surface area and a large size. Consequently, it is possible to obtain a sufficient ink fluidity without causing a blur in handwriting or a break in handwriting.

According to the fifth aspect of the invention, the ballpoint pen tip can be smoothly pressed and fitted into the penholder and the fitting hole of the connecting member. Thus, it is possible to prevent pressing and fitting failures from being generated.

What is claimed is:

1. A ballpoint pen tip rotatably holding a ball, comprising:

a metallic pipe body having a plurality of inwardly projecting portions for a ball receiving seat which are formed by inwardly pressing and deforming a neighborhood of a front end portion of said pipe body, and a front end edge portion which is formed by inwardly pressing and deforming the front end portion of the pipe body; and a ball rotatably held between said front edge portion and said plurality of inwardly projecting portions;

wherein a relation of $A/T>5.8$ is satisfied, where A is an outer diameter of the ball and T is a thickness of the pipe body.

2. The ballpoint pen tip according to claim 1, wherein a relation of $D/T>2.0$ is satisfied, where D is a depth of a concave portion which is formed at an outside of the inwardly projecting portions.

3. The ballpoint pen tip according to claim 2, wherein a relation of $2.0<D/T<4.0$ is satisfied.

4. The ballpoint pen tip according to claim 2, wherein the concave portion has a shape of a conical surface.

5. The ballpoint pen tip according to claim 1, wherein the outer diameter A of the ball is set in the range of 0.7 mm to 1.6 mm.

6. The ballpoint pen tip according to claim 5, wherein the outer diameter A of the ball is set in the range of 1.0 mm to 1.6 mm.

7. The ballpoint pen tip according to claim 1, wherein the inwardly projecting portions are provided in four places or more.

8. The ballpoint pen tip according to claim 7, wherein the inwardly projecting portions are provided in four places.

9. The ballpoint pen tip according to claim 1, wherein a curved surface portion is provided on an outer peripheral edge of a rear end of the pipe body.

10. The ballpoint pen tip according to claim 9, wherein the curved surface portion is formed through barrel polishing.

11. The ballpoint pen tip according to claim 9, wherein a radius of curvature of the curved surface portion is set in the range of 0.03 mm to 0.10 mm.

12. The ballpoint pen tip according to claim 9, wherein an outer diameter of a rear end of the pipe body is larger than 1.0 mm.

13. The ballpoint pen tip according to claim 1, wherein a ratio (B/T) of a diameter B of a virtual inscribing circle contacting apexes of said inwardly projecting portions to the thickness T of the pipe body is set in the range of 1.8 to 3.0.

14. The ballpoint pen tip according to claim 1, wherein an ink discharging gap is formed between the inwardly projecting portions and a ratio (S1/S2) of a sectional area S1 in a radial direction of the ink discharging gap to a sectional area S2 in a radial direction of an inner hole portion of a ball holding portion of the pipe body is set in the range of 0.10 to 0.39.

15. The ballpoint pen tip according to claim 1, wherein the pipe body is formed of austenite based stainless steel.

16. The ballpoint pen tip according to claim 1, wherein a relation of $5.8<A/T<10.0$ is satisfied.

17. A ballpoint pen comprising:

a ballpoint pen tip rotatably holding a ball, including a metallic pipe body having a front end edge portion and a plurality of inwardly projecting portions forming a ball receiving seat, wherein said plurality of inwardly projecting portions are formed by inwardly pressing and deforming a neighborhood of a front end portion of said pipe body, and said front end edge portion is formed by inwardly pressing and deforming the front end portion of the pipe body, and a ball rotatably held between said front edge portion and said plurality of inwardly projecting portions; and a synthetic resin member having a fitting hole into which said ballpoint pen tip is fittingly inserted, wherein a relation of $A/T>5.8$ is satisfied, where A is an outer diameter of the ball and T is a thickness of the pipe body, and a curved surface portion is provided on an outer peripheral edge of a rear end of the pipe body.

18. A ballpoint pen comprising:

a ballpoint pen tip rotatably holding a ball, including a metallic pipe body having a front end edge portion and a plurality of inwardly projecting portions forming a ball receiving seat, wherein said plurality of inwardly projecting portions are formed by inwardly pressing and deforming a neighborhood of a front end portion of said pipe body, and said front end edge portion is formed by inwardly pressing and deforming the front end portion of the pipe body, and a ball rotatably held between said front edge portion and said plurality of inwardly projecting portions;

a connecting member made of synthetic resin and having a fitting hole into which said ballpoint pen tip is fittingly inserted; and an ink reservoir having a front end opening to which said connecting member is to be fastened, wherein an ink and a follower for moving forward with consumption of the ink are accommodated in the ink reservoir, and wherein a relation of $A/T>5.8$ is satisfied, where A is an outer diameter of the ball and T is a thickness of the pipe body.

19. A ballpoint pen comprising:

a ballpoint pen tip rotatably holding a ball, including a metallic pipe body having a front end edge portion and a plurality of inwardly projecting portions forming a ball receiving seat, wherein said plurality of inwardly projecting portions are formed by inwardly pressing and deforming a neighborhood of a front end portion of said pipe body, and said front end edge portion is formed by inwardly pressing and deforming the front end portion of the pipe body, and a ball rotatably held between said front edge portion and said plurality of inwardly projecting portions;

a connecting member made of synthetic resin, said connecting member having a fitting hole into which the ballpoint pen tip is fittingly inserted;

an ink holding member having a front end portion to which said the connecting member is to be fastened; and an ink tank formed behind the ink holding member, said ink holding member temporarily holding an excess ink with a rise in an internal pressure of the ink tank, wherein a relation of $A/T>5.8$ is satisfied, where A is an outer diameter of the ball and T is a thickness of the pipe body.

20. A ballpoint pen comprising:

a ballpoint pen tip rotatably holding a ball, including a metallic pipe body having a front end edge portion and a plurality of inwardly projecting portions forming a ball receiving seat, wherein said plurality of inwardly projecting portions are formed by inwardly pressing and deforming a neighborhood of a front end portion of said pipe body, and said front end edge portion is formed by inwardly pressing and deforming the front end portion of the pipe body, and a ball rotatably held between said front edge portion and said plurality of inwardly projecting portions;

a connecting member made of synthetic resin, said connecting member having a fitting hole into which the ballpoint pen tip is fittingly inserted;

a penholder having a front end portion to which the connecting member is fastened; and an ink impregnation member formed of a fiber or porous material and accommodated in said penholder, wherein a relation of $A/T>5.8$ is satisfied, where A is an outer diameter of said ball and T is a thickness of said pipe body.

* * * * *